US008109543B2

(12) United States Patent
Chirumbolo

(10) Patent No.: US 8,109,543 B2
(45) Date of Patent: Feb. 7, 2012

(54) BLOCKING DEVICE FOR THE DOOR OF AN ELECTRIC HOUSEHOLD APPLIANCE

(75) Inventor: Dino Chirumbolo, Settimo Torinese (IT)

(73) Assignee: ITW Industrial Components S.R.L. Con Unico Socio, Milan (IT)

( * ) Notice: Subject to any disclaimer, the term of this patent is extended or adjusted under 35 U.S.C. 154(b) by 963 days.

(21) Appl. No.: 11/914,407

(22) PCT Filed: May 16, 2006

(86) PCT No.: PCT/IB2006/001282

§ 371 (c)(1),
(2), (4) Date: Nov. 14, 2007

(87) PCT Pub. No.: WO2006/123220

PCT Pub. Date: Nov. 23, 2006

(65) Prior Publication Data

US 2008/0196707 A1 Aug. 21, 2008

(30) Foreign Application Priority Data

May 17, 2005 (IT) ..... TO2005A0333

(51) Int. Cl.
*E05C 3/06* (2006.01)

(52) U.S. Cl. ..... 292/201; 292/144; 126/195

(58) Field of Classification Search ..... 292/251.5, 292/DIG. 69, 144; 126/191, 197
See application file for complete search history.

(56) References Cited

U.S. PATENT DOCUMENTS

| | | | | |
|---|---|---|---|---|
| 4,082,078 | A | 4/1978 | Thuleen et al. | |
| 4,314,217 | A * | 2/1982 | Krasser | 335/188 |
| 4,796,932 | A * | 1/1989 | Tame | 292/112 |
| 4,825,027 | A | 4/1989 | Yoon | |
| 4,932,707 | A * | 6/1990 | Ekstran | 292/341.17 |
| 5,520,424 | A * | 5/1996 | Hapke et al. | 292/198 |
| 6,334,637 | B1 * | 1/2002 | Chioffi | 292/341.16 |
| 2005/0121919 | A1 | 6/2005 | Smock et al. | |
| 2007/0256715 | A1 * | 11/2007 | Oppel et al. | 134/57 DL |
| 2008/0100066 | A1 * | 5/2008 | Mueller et al. | 292/24 |

OTHER PUBLICATIONS

International Search Report for PCT/IB2006/001282 mailed Oct. 12, 2006.

* cited by examiner

*Primary Examiner* — Kristina Fulton

(74) *Attorney, Agent, or Firm* — Lowe Hauptman Ham & Berner, LLP

(57) ABSTRACT

A door blocking device including a retaining member movable, along a given path, between a work position and a rest position, in which it respectively cooperates with and does not cooperate with a coupling member of the door when the door is in a closed position; and controlled-actuation means for controlled actuation of the retaining member, and which include elastic means for pushing the retaining member into the rest position; means for moving the retaining member into the work position in opposition to the elastic means; a rotary member having at least one radially projecting peripheral lobe; and an electrically controlled actuator for moving the rotary member selectively between a first angular position, in which the at least one lobe does not interfere with the given path (T), thus allowing the retaining member to move between the work position and the rest position, and a second angular position, in which the lobe interferes with the given path to lock the retaining member in the work position in opposition to the elastic means.

12 Claims, 3 Drawing Sheets

Fig. 3
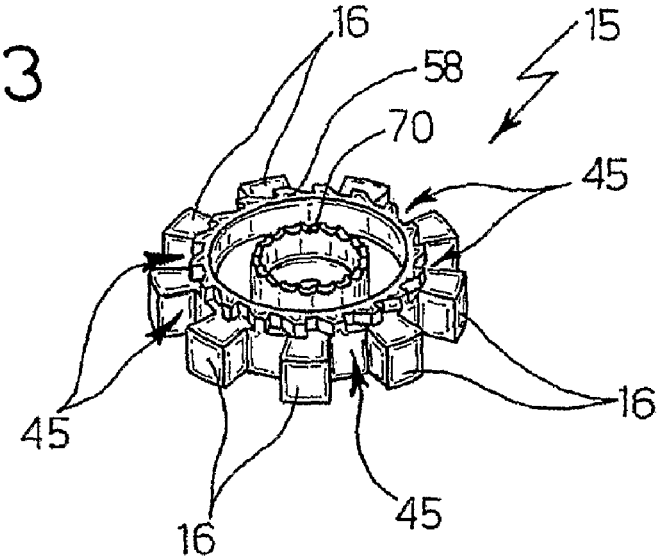
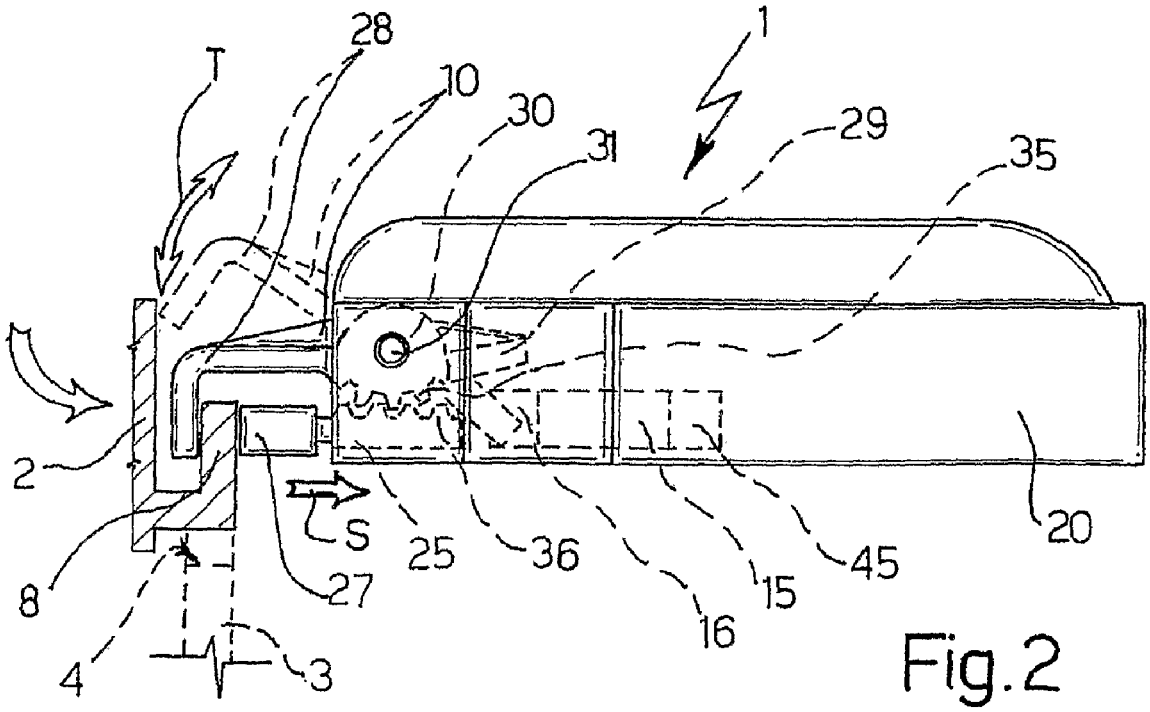
Fig. 2

BLOCKING DEVICE FOR THE DOOR OF AN ELECTRIC HOUSEHOLD APPLIANCE

RELATED APPLICATIONS

The present application is based on International Application No. PCT/IB2006/001282 filed May 16, 2006, and claims priority from Italian Application Number TO2005A000333 filed May 17, 2005, the disclosure of which is hereby incorporated by reference herein in its entirety.

TECHNICAL FIELD

The present invention relates to a blocking device for the door of an electric household appliance, particularly suitable for locking a pyrolytic oven door in the closed position.

BACKGROUND ART

As is known, for safety reasons, the door of numerous types of electric household appliances, such as washing-machines, dishwashers, and pyrolytic ovens, must be locked in the closed position when the appliance is operating, to prevent the user from inadvertently opening the door. Pyrolytic ovens, in particular, in addition to normal cooking cycles, also perform a self-cleaning cycle, in which the oven temperature is much higher than normal (and therefore potentially dangerous to the user) to remove, by pyrolysis, dirt (e.g. grease) particles from the walls of the oven. At least during the self-cleaning cycle, therefore, the oven door must be locked absolutely reliably.

Since known door blocking devices, such as those used on washing-machines and dishwashers, are unsuitable for ovens, particularly for the extremely high temperatures of pyrolytic ovens, special pyrolytic oven door blocking devices have been devised, which are normally operated by servomotors and therefore extremely expensive and, on the whole, bulky and complex in design.

DISCLOSURE OF INVENTION

It is an object of the present invention to eliminate the aforementioned drawbacks by providing a door blocking device which is cheap, compact, highly straightforward in design and operation, and therefore highly reliable. More specifically, it is also an object of the invention to provide a door blocking device of the above type which, being straightforward and inexpensive, can be used above all on pyrolytic ovens, but also on other types of electric household appliances in which a door must be kept locked in the closed position during at least one operating cycle of the appliance.

According to the present invention, there is provided a blocking device for the door of a electric household appliance, in particular a pyrolytic oven, as claimed in Claim 1.

More specifically, the door blocking device according to the invention comprises—all fitted to a support located, in use, close to a door opening of the door to be locked—a retaining member movable, along a given path, between a work position and a rest position, in which, in use, the retaining member respectively cooperates with and does not cooperate with a coupling member of the door when the door is in a closed position; and controlled-actuation means for controlled actuation of the retaining member, and which in turn comprise elastic means for pushing the retaining member into the rest position; means for moving the retaining member into the work position in opposition to the elastic means; a rotary member having at least one peripheral, radially projecting lobe; and an electrically controlled actuator, preferably defined by a straightforward electromagnet, for selectively moving the rotary member, preferably by means of a ratchet device, between a first angular position, in which the lobe does not interfere with the given path, thus allowing the retaining member to move between the work position and the rest position, and a second angular position, in which the lobe interferes with the given path, thus locking the retaining member in the work position in opposition to the elastic means.

The means for moving the retaining member into the work position comprise a push member which is movable with respect to the retaining member, cooperates with the door, and is functionally connected to the retaining member; the push member is supported to slide between a first and a second operating position, and is provided integral with a rack meshing with a ring gear integral with the retaining member, which is hinged, at an intermediate point between a first and a second of its own ends, about an axis perpendicular to the travelling direction of the push member.

The rotary member is defined by a wheel having a number of lobes separated by respective gaps; the wheel rotates about an axis perpendicular to both the axis of rotation of the retaining member and the travelling direction of the push member; and the wheel lies in a plane parallel to and different from that containing the axis of rotation of the retaining member, and is located, with respect to the retaining member, so that, in the second angular position, one lobe occupies the same position as the second end of the retaining member in the rest position, and rests against the second end of the retaining member in the work position.

The resulting door blocking device is thus highly compact, comprises very few moving parts, and can be operated by a straightforward electromagnet which is inexpensive and highly reliable even in the presence of very high temperatures. Moreover, the wheel is rotated in the same direction to both engage and release the device, which means one or both of the high-cost microswitches of known pyrolytic oven door blocking devices can be eliminated. In other words, a door blocking device in accordance with the invention is so straightforward and compact as to be usable not only on pyrolytic ovens but also other types of electric household appliances.

BRIEF DESCRIPTION OF THE DRAWINGS

A non-limiting embodiment of the present invention will be described by way of example with reference to the accompanying drawings, in which:

FIG. 2 shows a schematic top plan view of the FIG. 1 device fitted to a door of an electric household appliance shown only partly;

FIG. 3 shows a view in perspective, turned over 180° with respect to FIG. 1, of a component part of the FIG. 1 device;

BEST MODE FOR CARRYING OUT THE INVENTION

Figure 1:
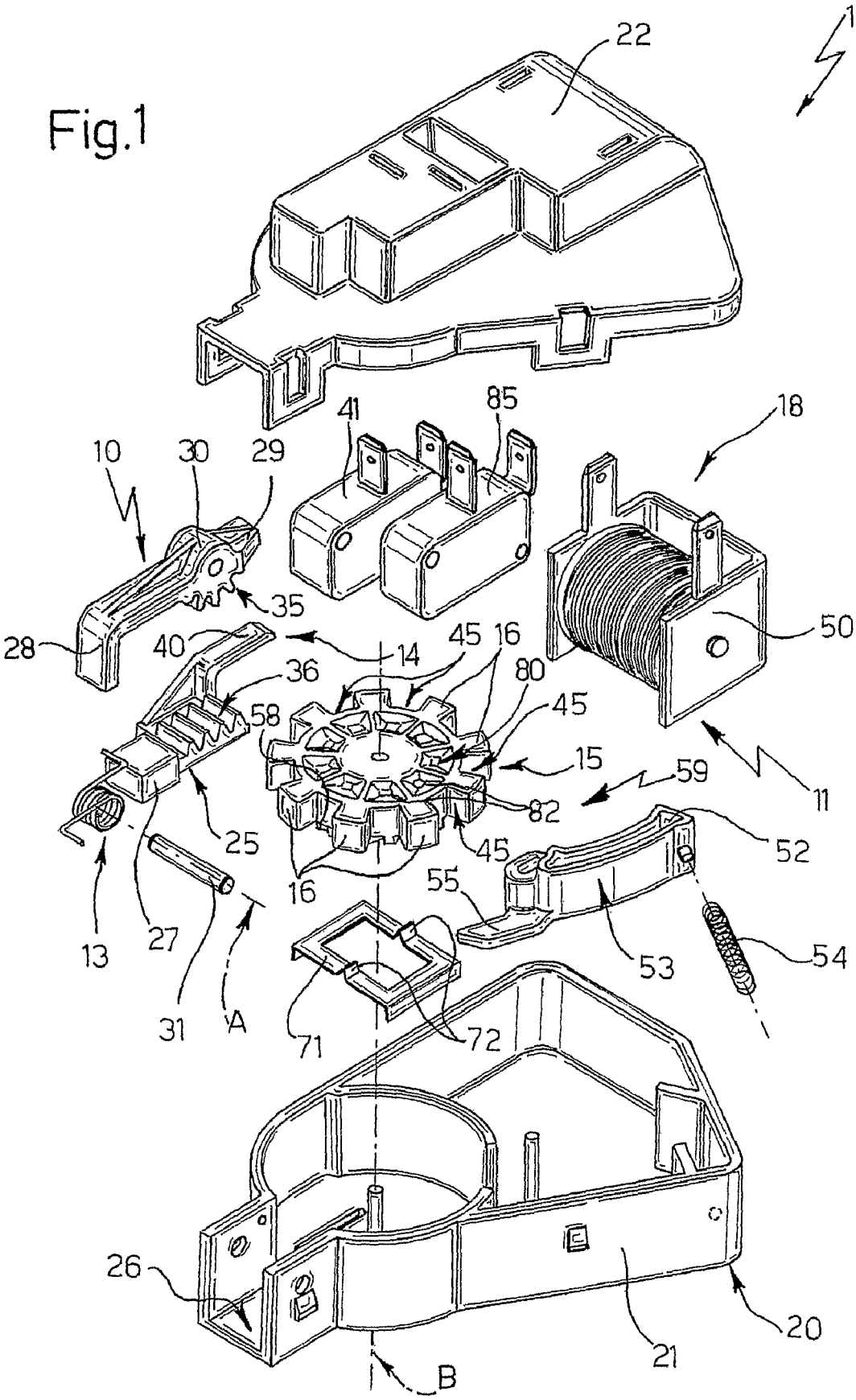
FIG. 1 shows a schematic, exploded, three-quarter front view in perspective of the door blocking device according to the invention.
Figure 4:
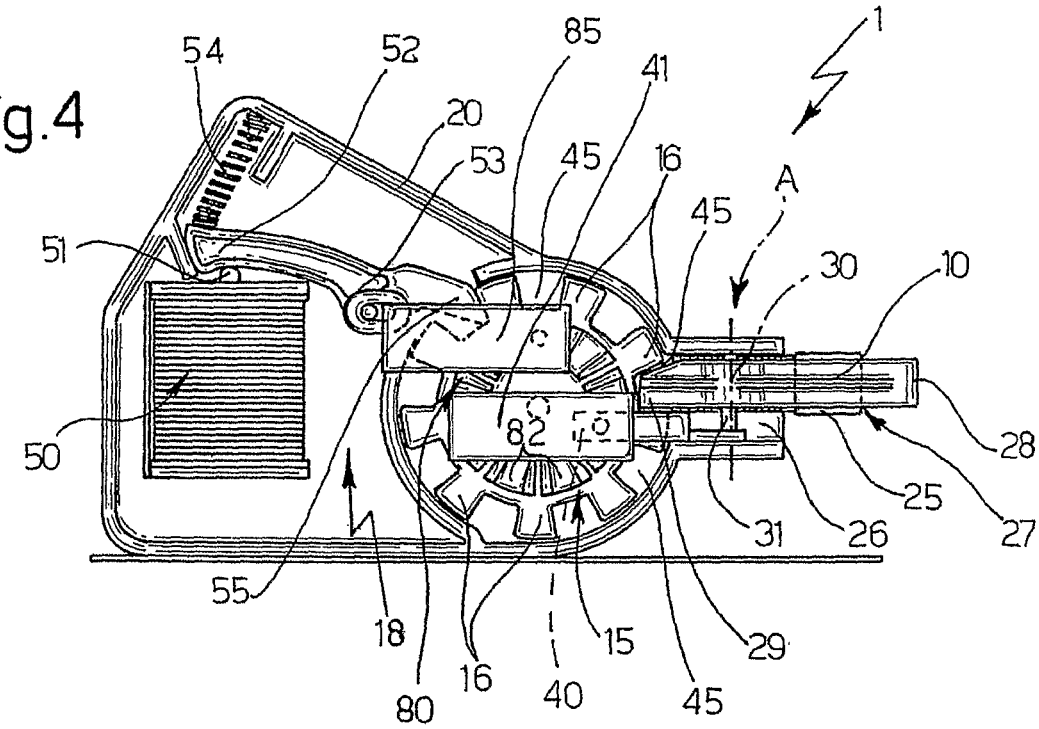
FIGS. 4 and 5 show schematic side views, from opposite sides and with parts removed for clarity, of the FIG. 1 device as assembled.

With reference to FIGS. 1 to 5, number 1 indicates as a whole a blocking device for a door 2 (FIG. 2) of an electric household appliance—in the example shown, a known pyrolytic oven, of which, for the sake of simplicity, is shown only part of a casing 3 defining a door opening 4, against which door 2 rests substantially in fluidtight manner in the closed position (the position shown)

Door blocking device 1 comprises a retaining member 10 movable, along a given path indicated by arrow T in FIG. 2, between a work position (shown by the continuous line in FIG. 2), in which retaining member 10 cooperates in use with a known coupling member 8 of door 2 when the door is in the closed position shown, and a rest position (shown partly by the dash line in FIG. 2), in which retaining member 10 does not cooperate in use with coupling member 8, by being located, for example, at a distance from coupling member 8 of door 2 in the closed position.

Figure 5:
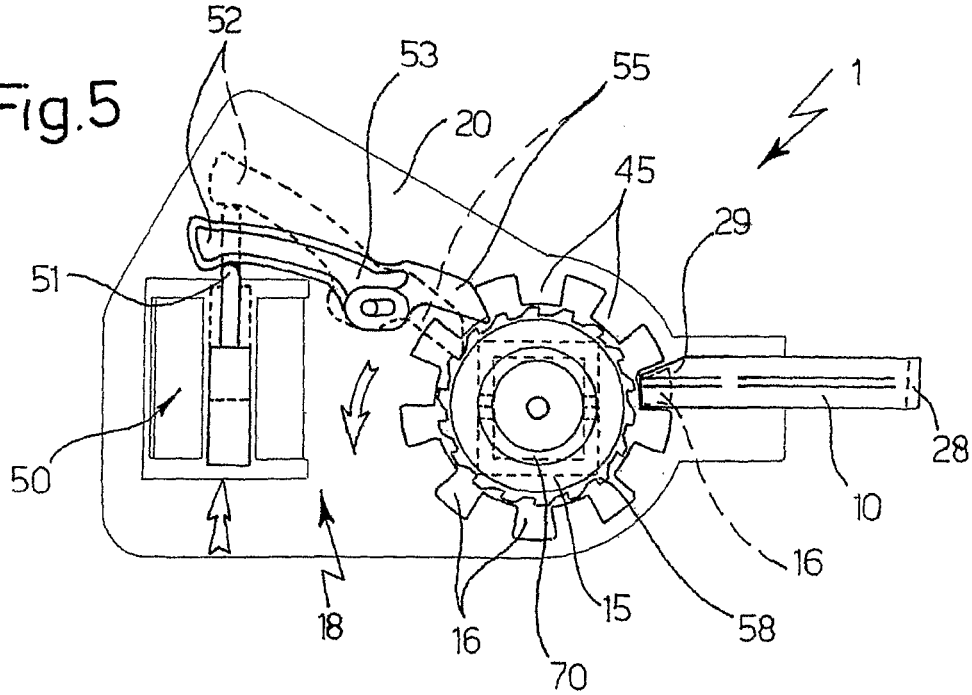

Device 1 also comprises controlled-actuation means 11 (FIG. 1) for controlled actuation of retaining member 10, and which, according to the invention, comprise elastic means 13 for pushing retaining member 10 into the rest position; means, indicated as a whole by 14, for moving retaining member 10, as will be seen, into the work position in opposition to elastic means 13; a rotary member 15 having at least one peripheral, radially projecting lobe 16; and an electrically controlled actuator 18 for moving rotary member 15 selectively between a first angular position, shown by the continuous line in FIGS. 1-5, and a second angular position, shown schematically by the dash line in FIG. 5.

According to the main aspect of the invention, rotary member 15 is designed and located so that, in the first angular position of rotary member 15, the at least one lobe 16 of the rotary member does not interfere with given path T travelled by retaining member 10 between the work position and the rest position, thus allowing retaining member 10 to move freely between the work and rest positions; whereas, in the second angular position of rotary member 15, the at least one lobe 16 interferes with given path T, thus locking retaining member 10 in the work position in opposition to elastic means 13.

Device 1 also comprises a support 20 which is fixed in use to door opening 4 of the electric household appliance (FIG. 2), and which supports retaining member 10 and controlled-actuation means 11 for controlled actuation of retaining member 10. Support 20 is preferably in the form of a substantially prismatic casing comprising at least two members 21, 22 (FIG. 1) molded from synthetic plastic material and joined, e.g. clicked, to each other, and at least one of which—in the example shown, both—is cup-shaped or in the form of a half-shell.

According to a further aspect of the invention, means 14 for moving retaining member 10 into the work position comprise a push member 25—in the form of a straight slide, in the example shown—which is connected functionally to retaining member 10, is fitted to support 20 to move with respect to retaining member 10, cooperates with and is moved by door 2 into a first operating position (FIG. 2) when the door is moved into the closed position, and remains resting against door 2, locked by the door in the first operating position, when door 2 is in the closed position.

More specifically, push member 25 is fitted in sliding manner to support 20, and projects from a seat 26 formed in support 20 and facing door 2 in use. And push member 25 and retaining member 10 are connected functionally so that, when push member 25 is in the first operating position, housed in a withdrawn position inside seat 26, retaining member 10 is in the work position; and, conversely, when retaining member 10 is in the rest position, push member 25 is secured in a second operating position (not shown), in which push member 25 is extracted from seat 26, with an end 27, facing door 2 in use, of the push member projecting from seat 26 by a greater amount than in the withdrawn position, so that end 27 contacts door 2, as door 2 moves into the closed position (in the direction indicated by the arrow in FIG. 2), long before door 2 contacts a corresponding first end 28 of retaining member 10 projecting from seat 26 on the side facing door 2 in use.

In the example shown, retaining member 10 is hinged to support 20 at an intermediate point or portion 30 not necessarily equidistant from end 28 and a corresponding opposite end 29 of retaining member 10, so that ends 28, 29 are free to rotate in the same direction about an axis A defined, for example, by a pin 31, extending crosswise inside seat 26 in such a position as not to interfere with the travel of push member 25 inside seat 26, and perpendicular to the travelling direction of push member 25 indicated by arrow S in FIG. 2.

End 28 is hook-shaped to retain coupling member 8 in use; at intermediate point 30, retaining member 10 has an integral ring gear 35 coaxial with axis of rotation A and meshing with a rack 36 integral with push member 25; and elastic means 13 comprise a torsion spring—helical in the example shown—fitted coaxially to and preferably preloaded on pin 31, and which acts directly on retaining member 10, pushing against support 20 (against member 21 in the example shown), to produce a torque in such a direction as to rotate retaining member 10 into (and, in the absence of other forces, to keep the retaining member rotated in) the rest position.

As shown by the dash line in FIG. 2, in the rest position, end 28 is parted apart with respect to end 27 of push member 25, which is in the extracted position.

At the opposite end to end 27, push member 25 (FIG. 1) has a projecting L-shaped appendix 40 which cooperates in known manner (FIG. 4) with a first microswitch 41, housed in support 20, to activate microswitch 41, when push member 25 is fully withdrawn (except for end 27) inside seat 26, and so obtain a "door closed" signal from microswitch 41.

In the example shown, rotary member 15 is defined by a wheel having a number of radially projecting lobes 16 equally spaced and separated circumferentially by respective gaps 45; wheel 15 is fitted to support 20 to rotate about an axis B (FIG. 1) perpendicular to both axis of rotation A of retaining member 10 and the travelling direction S of push member 25; and second end 29 of retaining member 10 is shaped to fit selectively, as will be seen, inside gaps 45 when retaining member 10 is in the rest position; for which purpose, wheel 15 is fitted to support 20 to lie in a plane parallel to and different from that containing axis of rotation A of retaining member 10.

Wheel 15 selectively assumes said first and second angular position by rotating in the same direction by a fraction of a turn equal to the number of lobes 16 (i.e. the number of gaps 45), and is so located in support 20 and with respect to retaining member 10 that, in the second angular position, one of lobes 16 always occupies the same position (i.e. volumetric portion of space) otherwise occupied by end 29 when retaining member 10 is in the rest position.

The relative position of wheel 15 in support 20 is also such that, likewise, when wheel 15 is in the second angular position, one of lobes 16 rests against end 29 when retaining member 10 is in the work position, thus preventing elastic means 13 from rotating retaining member 10.

Electrically controlled actuator 18 comprises an electromagnet 50, an armature 51 of which acts on a first end 52 of a rocker arm 53 to oscillate the rocker arm in a given direction, and in opposition to a return spring 54, whenever electromagnet 50 is energized; a second end 55, opposite end 52, of rocker arm 53 is in the form of a pawl, and cooperates with a serrated ring gear 58 fitted laterally to wheel 15; and end 55 and ring gear 58 thus form a known ratchet device 59 (FIG. 1) for rotating wheel 15 by said fraction of a turn whenever electromagnet 50 is energized and oscillates rocker arm 53.

With particular reference to FIGS. 1 and 3, a first face of wheel 15, on the same side as lateral ring gear 58, has a ring gear 70 having teeth equal in number to lobes 16 and shaped to cooperate with an elastic member 71—in the example shown, in the form of a rectangular frame having projections 72 halfway along the major, and therefore more flexible, sides—which selectively clicks inside the gaps between the teeth on ring gear 70 to ensure correct angular positioning of lobes 16 or gaps 45 exactly at end 29, regardless of the operating precision of ratchet device 59 and electromagnet 50, which may thus be low-cost technology types.

A second face of wheel 15, opposite the first and therefore on the opposite side to lateral ring gear 58 and ring gear 70, has a circular track 80 defined by alternating projections and/or cavities 82, possibly separated by flat portions, and equal in number to lobes 16; and a second microswitch 85, housed in support 20, cooperates (FIG. 4) with circular track 80, so as to be selectively activated/deactivated at each fraction of a turn of wheel 15, and so as to obtain from microswitch 85 a signal indicating the presence (or absence) of a lobe 16 in the position shown by the dash line in FIG. 5.

The blocking device, described with non-limiting reference to application to a pyrolytic oven, operates as follows.

When door 2 is in the open position (not shown), the inside of the oven is accessible to the user through door opening 4, and wheel 15 is in the first angular position described above, in which a gap 45 of wheel 15 is located between the bottom wall of cup-shaped member 21 of support 20 and retaining member 10 and is aligned beneath end 29. In which condition, spring 13 is able to keep member 10 in the rest position, in which said gap 45 is engaged by end 29, and end 28 is parted with respect to end 27 of member 25.

When door 2 is pushed shut manually by the user (or by a servomotor), member 25 is pushed by door 2 into the withdrawn position, thus rotating member 10 by means of rack 36 and ring gear 35, and so rotating end 28 towards end 27 to reduce and eventually eliminate the distance between the two, so that, when door 2 is finally closed, member 8 is engaged by end 28.

This condition being reached, microswitch 41 is activated by appendix 40 to produce a signal, which is used by the electric household appliance to energize electromagnet 50 and rotate wheel 15 by a fraction of a turn as described above, so that, beneath end 29 (with reference to the bottom wall of member 21 of support 20), a gap 45 is replaced by a lobe 16. This prevents the elastic reaction of spring 13, even if no pressure is applied on door 2, from rotating member 10 backwards, by virtue of end 29, in that case, interfering with and resting against lobe 16 on the circular track 80 side. Door 2 is thus locked; and rotation of wheel 15 also activates microswitch 85, which produces a consent signal to start the self-cleaning (pyrolysis) function of the oven.

Once the function is completed, the central control unit of the oven energizes electromagnet 50 again to again rotate wheel 15 by a fraction of a turn, so that lobe 16 is replaced by a gap 45 beneath end 29; and, end 29 no longer being retained by lobe 16, spring 13 is free to rotate member 2 into the rest position, thus parting ends 28 and 27 and releasing member 8.

In this condition, door 2 is no longer locked and, in fact, is pushed automatically into a position slightly detached from door opening 4, thus opening the oven, by virtue of rotation of member 10, by means of ring gear 35 and rack 36, moving member 25 into the withdrawn position, so that door 2 is pushed by end 27 into the open position.

The invention claimed is:

1. A blocking device for a door of an electric household appliance, said device comprising:

a retaining member rotatable about a first axis of rotation between a work position and a rest position for locking and unlocking the door, respectively;

an elastic element for biasing the retaining member into the rest position;

a push member for moving the retaining member into the work position in opposition to the elastic element, wherein said push member is moveable between first and second operating positions corresponding to the work position and the rest position of the retaining member, respectively;

a wheel having a number of radially projecting lobes equally spaced and separated circumferentially by respective gaps, said wheel being rotatable about a second axis of rotation which is perpendicular to the first axis of rotation of the retaining member, said wheel lying in a plane parallel to and different from that containing the first axis of rotation of the retaining member;

an electrically controllable actuator for moving the wheel selectively between a first angular position, in which said lobes do not interfere with a rotational movement of the retaining member, thus allowing the retaining member to rotate between the work position and the rest position, and a second angular position, in which one of said lobes interferes with the rotational movement of the retaining member, thus locking the retaining member in the work position in opposition to the elastic element.

2. The blocking device of claim 1, wherein the second axis of rotation of said wheel is perpendicular to a traveling direction of the push member between the first and second operating positions.

3. The blocking device of claim 1, wherein said retaining member has opposite first and second ends, and an intermediate portion which is between said first and second ends and through which said first axis of rotation extends; and the first end of said retaining member is arranged for cooperating with a coupling member of the door in the work position; and the second end of said retaining member is shaped to fit selectively inside one of said gaps in the rest position, and is engageable with one of said lobes when the wheel is in the second angular position, thus locking the first end in the work position.

4. The blocking device of claim 3, wherein said actuator is arranged to rotate said wheel in the same direction by a fraction of a turn equal to the number of said lobes; and when the wheel is in the second angular position, one said lobe occupies the same position as said second end of the retaining member in the rest position, and rests against said second end of the retaining member in the work position, thus preventing the elastic element from rotating the retaining member.

5. The blocking device of claim 1, wherein said actuator comprises:

an electromagnet, a rocker arm having a first end and a second end in the form of a pawl, a return spring, and a serrated ring gear fitted laterally to said wheel and cooperating with the pawl, wherein said electromagnet is arranged for acting, when energized, on the first end of the rocker arm to oscillate the rocker arm in opposition to the return spring, and to cause the second end of the rocker arm to rotate, via the serrated ring gear, the wheel by a fraction of a turn when the rocker arm is oscillated.

6. The blocking device of claim 1, wherein:

a first face of said wheel has a ring gear having teeth equal in number to said lobes; and said device further comprises an elastic member having a projection which selectively clicks inside gaps between the teeth of said ring gear for ensure correct angular positioning of said lobes of the wheel.

7. The blocking device of claim 6, wherein:

a second, opposite face of said wheel has a circular track defined by alternating projections and/or cavities equal in number to said lobes;

said device further comprises a switch cooperating with said circular track, so as to be selectively activated/deactivated at each fraction of a turn of the wheel, and to produce a signal for enabling a function of the appliance.

8. A blocking device for a door of an electric household appliance, said device comprising:

a retaining member moveable between a work position and a rest position for locking and unlocking the door, respectively;

an elastic element for biasing the retaining member into the rest position;

a push member for moving the retaining member into the work position in opposition to the elastic element, wherein said push member is moveable between first and second operating positions corresponding to the work position and the rest position of the retaining member, respectively;

a rotary member having at least one peripheral, radially projecting lobe;

an electrically controllable actuator for moving the rotary member selectively between a first angular position, in which said lobe does not interfere with a movement of the retaining member, thus allowing the retaining member to move between the work position and the rest position, and a second angular position, in which the lobe interferes with the movement of the retaining member, thus locking the retaining member in the work position in opposition to the elastic element; and a casing adapted to be fixed to a door opening of the electric household appliance, and housing therein the retaining member, the elastic element, the push member and the rotary member;

wherein the retaining member is rotatable about a first axis of rotation between the work position and the rest position;

said rotary member is rotatable about a second axis of rotation which is perpendicular to the first axis of rotation of the retaining member, said wheel lying in a plane parallel to and different from that containing the first axis of rotation of the retaining member;

the retaining member has an end that projects from within said casing to an outside of said casing for cooperating with a coupling member of the door in the work position;

the push member has an end that projects from within said casing to the outside of said casing to be acted on by the door, as the door is being moved into a closed position, thereby moving the push member from the second operating positions into the first operating position; and the end of said push member is arranged to rest against the door, thereby locking the push member in said first operating position, when the door is in the closed position.

9. The blocking device of claim 8, wherein:

the end of the retaining member is pivoted away from the end of the push member as the retaining member rotates from the work position to the rest position.

10. The blocking device of claim 8, wherein said end of the retaining member is located outside the casing regardless of whether the retaining member is in the work position or the rest position or any intermediate position between said work and rest positions.

11. The blocking device of claim 8, further comprising:

a switch arranged to be activated by the push member when the push member is moved into the first operating position, and to produce a signal for causing the actuator to move the rotary member into the second angular position for locking the retaining member in the work position.

12. The blocking device of claim 8, wherein:

said retaining member and said push member are in meshing engagement.

* * * * *